US006817142B2

(12) United States Patent
Marshik

(10) Patent No.: US 6,817,142 B2
(45) Date of Patent: Nov. 16, 2004

(54) METHODS AND APPARATUS FOR A SINGLE LEVER TILT LOCK LATCH WINDOW

(75) Inventor: Gary J. Marshik, Canton, SD (US)

(73) Assignee: Amesbury Group, Inc., Amesbury, MA (US)

( * ) Notice: Subject to any disclaimer, the term of this patent is extended or adjusted under 35 U.S.C. 154(b) by 104 days.

(21) Appl. No.: 10/041,784

(22) Filed: Oct. 19, 2001

(65) Prior Publication Data

US 2002/0116874 A1 Aug. 29, 2002

Related U.S. Application Data

(60) Provisional application No. 60/241,990, filed on Oct. 20, 2000.

(51) Int. Cl.[7] ..... E05B 55/00; E05D 15/22

(52) U.S. Cl. ..... 49/449; 49/185; 292/DIG. 20; 292/DIG. 47

(58) Field of Search ..... 49/449, 181, 450, 49/183, 185, 301, 447; 292/34, 33, 36, 51, 6, 67, 203, DIG. 20, DIG. 35, DIG. 47, 175, 35

(56) References Cited

U.S. PATENT DOCUMENTS

| | | | | |
|---|---|---|---|---|
| 201,146 | A | | 3/1878 | Adler |
| 336,302 | A | | 2/1886 | Dudgeon |
| 480,148 | A | | 8/1892 | Theby |
| 878,206 | A | | 2/1908 | Johnson |
| 1,041,803 | A | | 10/1912 | Kilburn |
| 1,059,999 | A | | 4/1913 | James et al. |
| 1,253,810 | A | | 1/1918 | Gianninoto |
| 1,393,628 | A | | 10/1921 | Leichter |
| 1,550,532 | A | | 8/1925 | French |
| 1,704,946 | A | | 3/1929 | Lindgren |
| 1,901,974 | A | | 3/1933 | Macy |
| 2,537,736 | A | | 1/1951 | Carlson ..... 292/182 |
| 3,027,188 | A | | 3/1962 | Eichstadt ..... 296/51 |
| 3,438,153 | A | | 4/1969 | Di Lemme ..... 49/451 |
| 3,811,718 | A | | 5/1974 | Bates ..... 292/241 |
| 4,227,345 | A | | 10/1980 | Durham, Jr. ..... 49/181 |
| 4,305,612 | A | | 12/1981 | Hunt et al. ..... 292/336.3 |
| 4,961,286 | A | | 10/1990 | Bezubic ..... 49/175 |
| 5,072,464 | A | | 12/1991 | Draheim et al. ..... 5/93.1 |
| 5,076,015 | A | | 12/1991 | Manzalini ..... 49/192 |
| 5,087,088 | A | | 2/1992 | Milam ..... 292/110 |
| 5,090,750 | A | | 2/1992 | Lindqvist ..... 292/7 |
| 5,127,685 | A | | 7/1992 | Dallaire et al. ..... 292/175 |
| 5,139,291 | A | | 8/1992 | Schultz ..... 292/42 |
| 5,219,193 | A | | 6/1993 | Piltingsrud ..... 292/240 |
| 5,244,238 | A | | 9/1993 | Lindqvist ..... 292/7 |
| 5,398,447 | A | | 3/1995 | Morse ..... 292/67 |
| 5,715,631 | A | * | 2/1998 | Kailian et al. ..... 49/450 |
| 5,911,763 | A | | 6/1999 | Quesada ..... 70/120 |
| 5,992,907 | A | | 11/1999 | Sheldon et al. ..... 292/34 |
| 6,141,913 | A | | 11/2000 | Wong et al. ..... 49/465 |
| 6,588,150 | B1 | * | 7/2003 | Wong et al. ..... 49/183 |
| 2003/0110698 | A1 | | 6/2003 | Polowinczak et al. ..... 49/181 |

FOREIGN PATENT DOCUMENTS

| | | |
|---|---|---|
| CA | 2382935 | 3/2003 |
| GB | 341207 | 2/1931 |
| GB | 2 026 594 A | 2/1980 |
| WO | WO 01/38677 | 5/2001 |

* cited by examiner

*Primary Examiner*—Hugh B. Thompson, II
(74) *Attorney, Agent, or Firm*—Testa, Hurwitz & Thibeault, LLP

(57) ABSTRACT

An apparatus for a tilt lock latch mechanism to be incorporated in double hung windows. In one embodiment, the tilt lock latch mechanism includes a rotatable element which rotates serially from a locked position, to an open position, to a tilt position.

20 Claims, 24 Drawing Sheets

METHODS AND APPARATUS FOR A SINGLE LEVER TILT LOCK LATCH WINDOW

RELATED APPLICATIONS

This application incorporates by reference in its entirety and claims priority to U.S. Provisional Patent Application Ser. No. 60/241,990 entitled Methods And Apparatus For A Single Lever Tilt Lock Latch Window filed on Oct. 20, 2000.

FIELD OF THE INVENTION

This invention relates generally to window locks and more specifically to methods and apparatus for a single lever tilt lock latch window.

BACKGROUND OF THE INVENTION

This invention relates to the field of tilt-in windows. More particularly this invention relates to a tilt lock latch mechanism that locks a first window sash to a second window sash to prevent relative sliding movement between the window sashes and also allows the first window sash to be tilted relative to the second window sash and the window frame.

Typical double hung windows include two window sashes disposed in tracks located in a window frame to allow vertical sliding movement of the sashes in the window frame. One problem with double hung windows is that they are difficult to wash. In order to clean the outside of a double hung window, a person cleaning the window must go outside to clean the outside surface of the window or attempt to reach through the window, which is awkward.

In order to eliminate the problem of having to go outside or reach through to clean the outside surface of a window, some window sashes have been designed to tilt in from the window frame. Tilt-in windows typically have two manually operated retractors, one located on each side at the top surface of the upper rail of each window sash. To tilt the sash in, the retractor on each side of the window sash is retracted from its track, allowing the window sash to tilt in about a lower pivot axis of the window sash, typically at the lower rail. One problem with typical tilt-in windows is that it is difficult to simultaneously retract the retractors on both sides of the window sash. Two hands must be used at the same time, i.e., one hand for each retractor, to tilt the window in from the sliding position in the window frame.

In order to eliminate the problem of having to operate tilt-in windows using two hands, centrally located tilt-in handles or levers has been devised. See, for example, U.S. Pat. No. 5,992,907 entitled "Lock and Tilt Latch for Sliding Windows" issued to Sheldon et al. and U.S. Pat. No. 5,398,447 entitled "Centrally Located Tilt-In Window Handle" issued to Morse, the disclosures of which are herein incorporated by reference in their entirety.

While, these and other centrally located tilt-in handles or levers may be easier to operate than a pair of window sash retractors, some latch mechanisms are difficult to operate. Further, centrally located latches of this type, particularly those which provide both sash lock and tilt features, can have problems providing reliable and smooth operation over the life of the window. Also some centrally located tilt-in windows require a first lever to lock one window sash relative to the second window sash and a second lever to tilt the window in relative to a window frame, adding to the complexity and cost of the window hardware.

SUMMARY OF THE INVENTION

The present invention relates to a single lever tilt lock latch mechanism mounted to a first window sash that allows the window sash to be locked, opened, and tilted in.

The tilt lock latch mechanism includes a rotatable element mounted to a housing. The rotatable element includes a keeper that can be received in a receiver located in a second window sash to prevent relative sliding movement of the first window sash and the second window sash when engaged. The tilt lock latch mechanism further includes a retractable element disposable remote from the housing and a transmission connecting the rotatable element with the retractable element to permit the first window sash to be tilted away from the second window sash and window frame when the retractable element is retracted from its track in the window frame. In a first angular position, the rotatable element positions the rotatable element keeper in the receiver in a locked position to prevent relative sliding movement of the first window sash and the second window sash. In a second angular position, the rotatable element keeper is positioned in an open position to permit relative sliding movement of the first window sash and the second window sash. In a third angular position, the rotatable element is positioned in a tilt position, retracting the retractable element to permit the first window sash to be tilted away from the second window sash and the window frame. In operation, the rotatable element rotates serially from the first angular locked position to the second angular open position to the third angular tilt position.

In one embodiment, the tilt lock latch mechanism transmission includes a ligament connected to the retractable element, which is biased in an extended position in the window frame track. The tilt lock latch mechanism may include a single lever for manual actuation of the rotatable element.

In another embodiment, the invention includes a tilt lock latch mechanism for use in a window assembly. The window assembly includes a window frame having a pair of window frame slots or tracks, a first window sash, a second window sash, and a pair of retractable tilt latches on opposite ends of the top rail of the first window sash. The retractable tilt latches are in communication with respective window frame slots for supporting the first window sash in sliding relation with the window frame. The tilt lock latch mechanism has a housing mounted on the first window sash. The tilt lock latch mechanism also has a rotatable element, including a keeper, which is mounted on the housing. A receiver is mounted on the second window sash to accept the rotatable element keeper to prevent relative sliding movement between the first window sash and the second window sash when the rotatable element is moved to a locked position and to permit relative sliding movement between the first window sash and the second window sash when moved to an open position. The tilt lock latch mechanism further includes a transmission interdisposed between the rotatable element and the pair of retractable tilt latches, wherein the pair of retractable tilt latches are retracted from the window frame slots when the rotatable element is moved beyond the open position to a tilt position, permitting the first window sash to be tilted relative to the window frame. The rotatable element rotates serially from the locked position to the open position to the tilt position.

BRIEF DESCRIPTION OF THE DRAWINGS

The above and further advantages of this invention may be better understood by referring to the following description, taken in conjunction with the accompanying drawings, in which.

DETAILED DESCRIPTION OF THE INVENTION

Figure 1A:
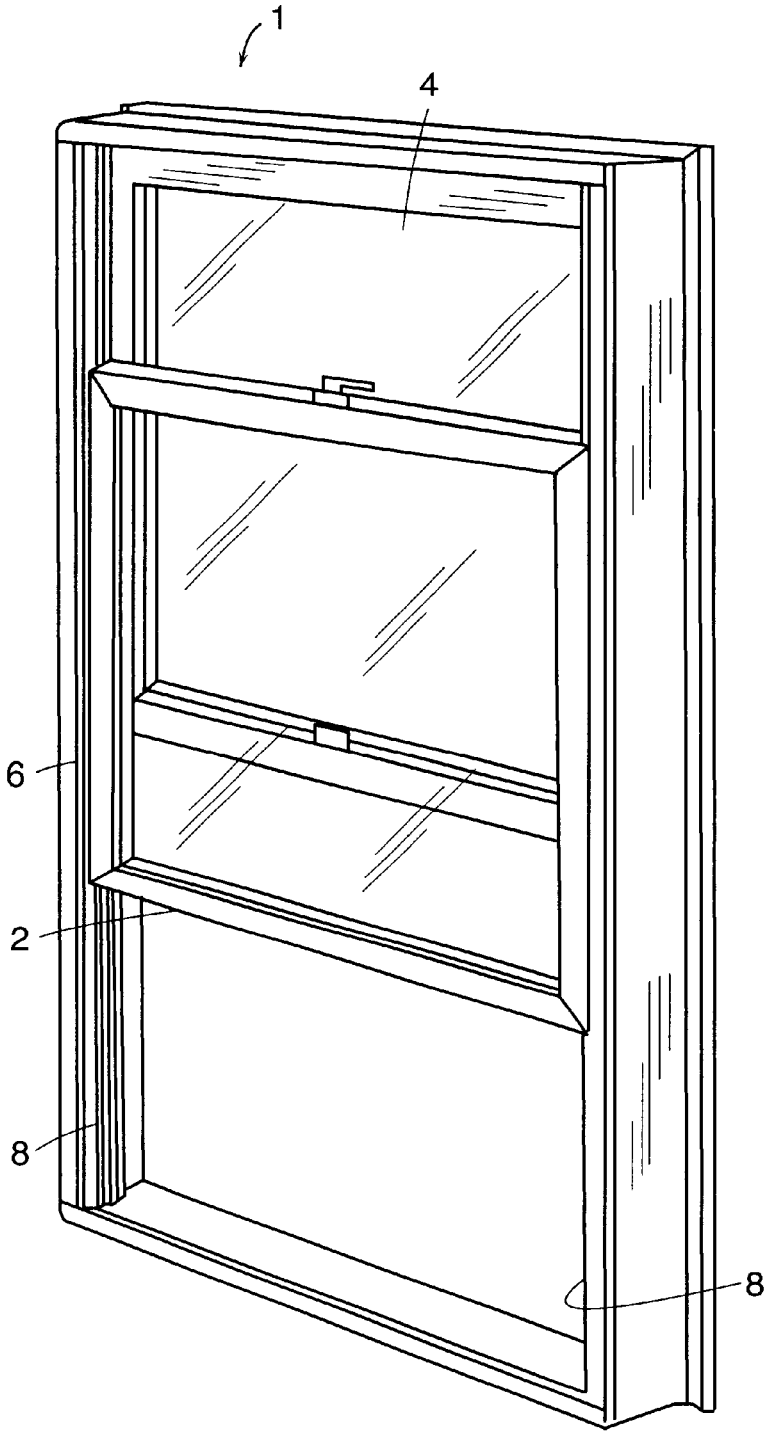
FIG. 1A is a perspective view of a double hung window assembly in which the tilt lock latch of the present invention can be used.

Referring to FIG. 1A, shown is a double-hung window assembly 1 in which a tilt lock latch mechanism constructed in accordance with the teachings of the present invention can be used. The window assembly 1 includes of a first window sash 2, a second window sash 4, and a window frame 6 in which the first window sash 2 and the second window sash 4 are supported. The first window sash 2 and the second window sash 4 slide vertically in window slots 8 of the window frame 6 in the window assembly 1.

Figure 1B:
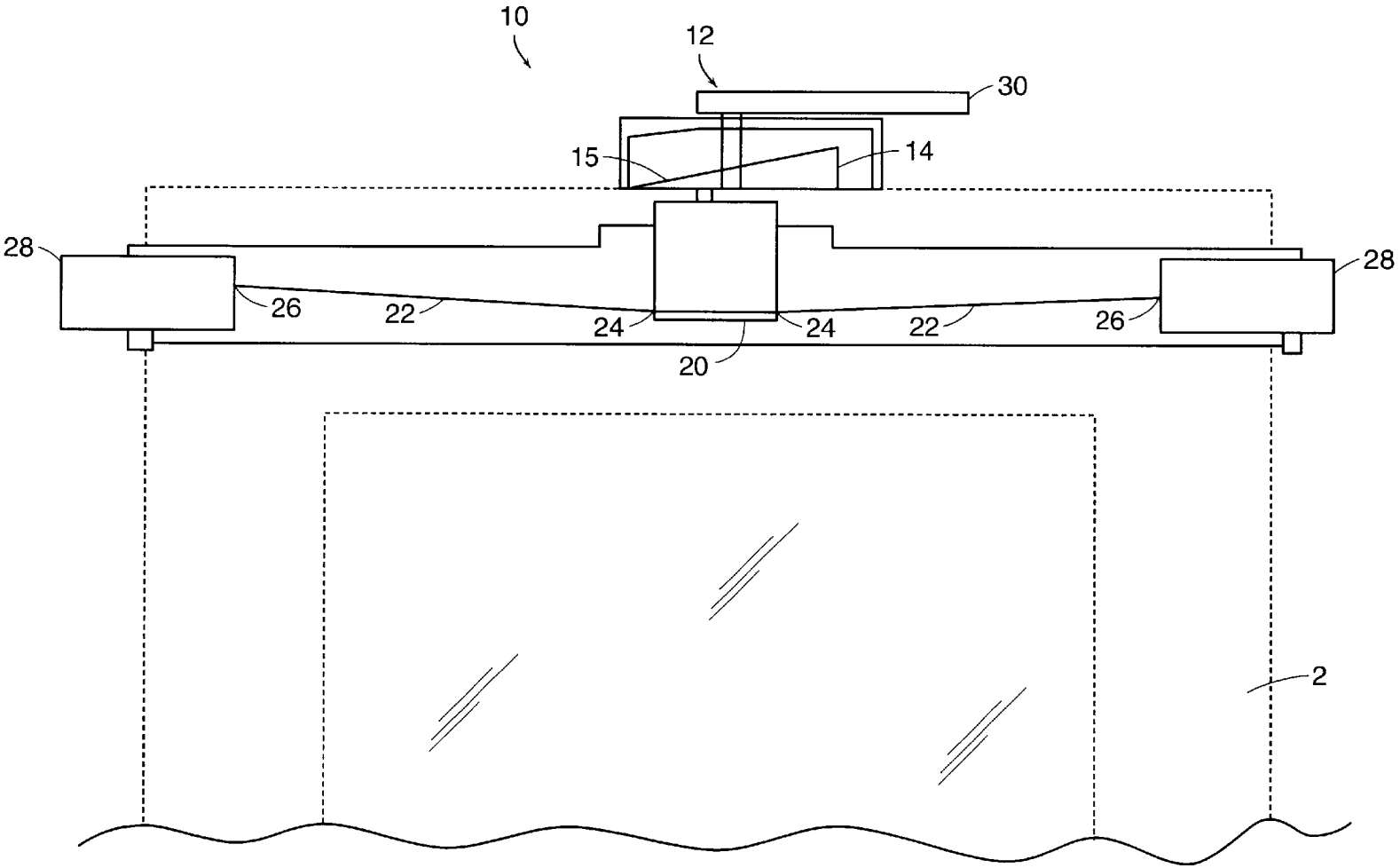
FIG. 1B is a schematic diagram of an embodiment of the present invention.
Figure 2B:
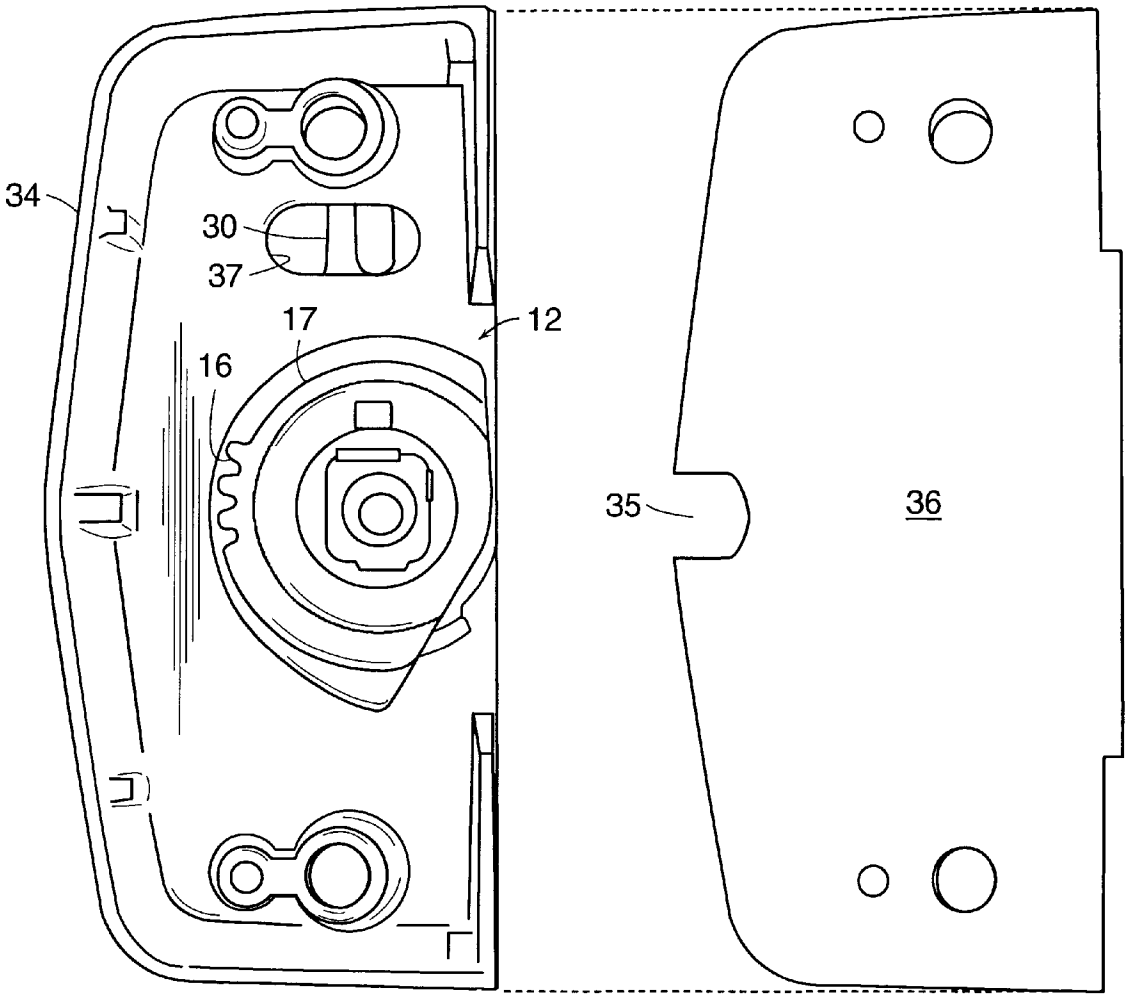
FIG. 2B is an exploded bottom view of an embodiment of the current invention illustrating a cover plate, lever, keeper, and a toothed portion of the keeper.
Figure 2A:
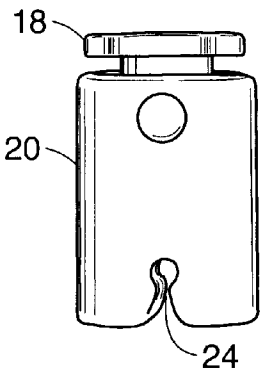
FIG. 2A is a side view of a gear and contoured outer surface.
Figure 10:
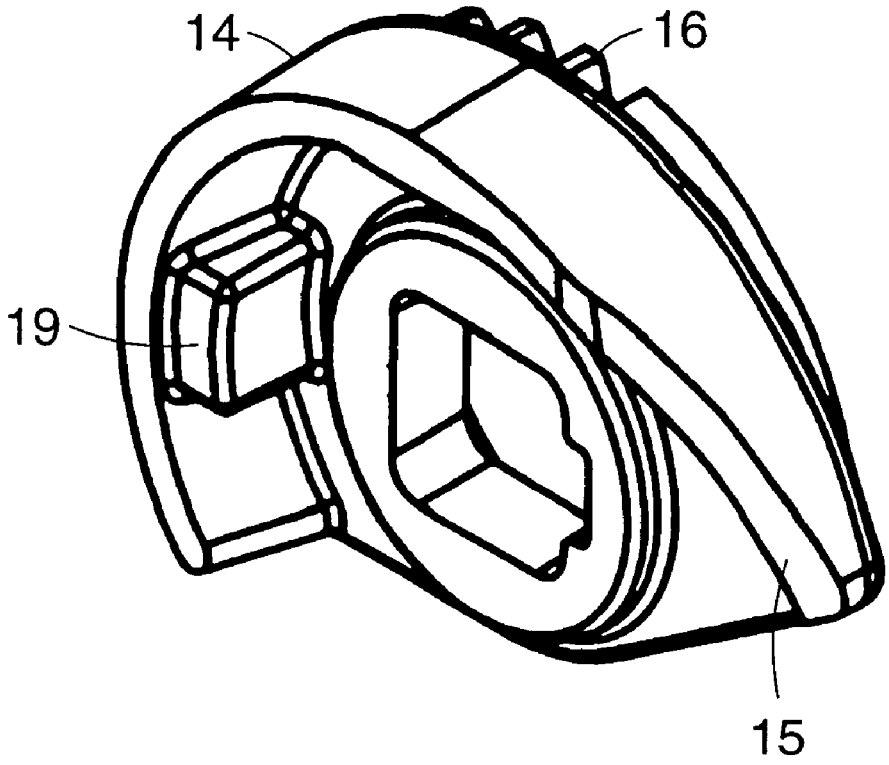
FIG. 10 is a perspective view of an embodiment of the current invention illustrating a keeper.
Figure 11:
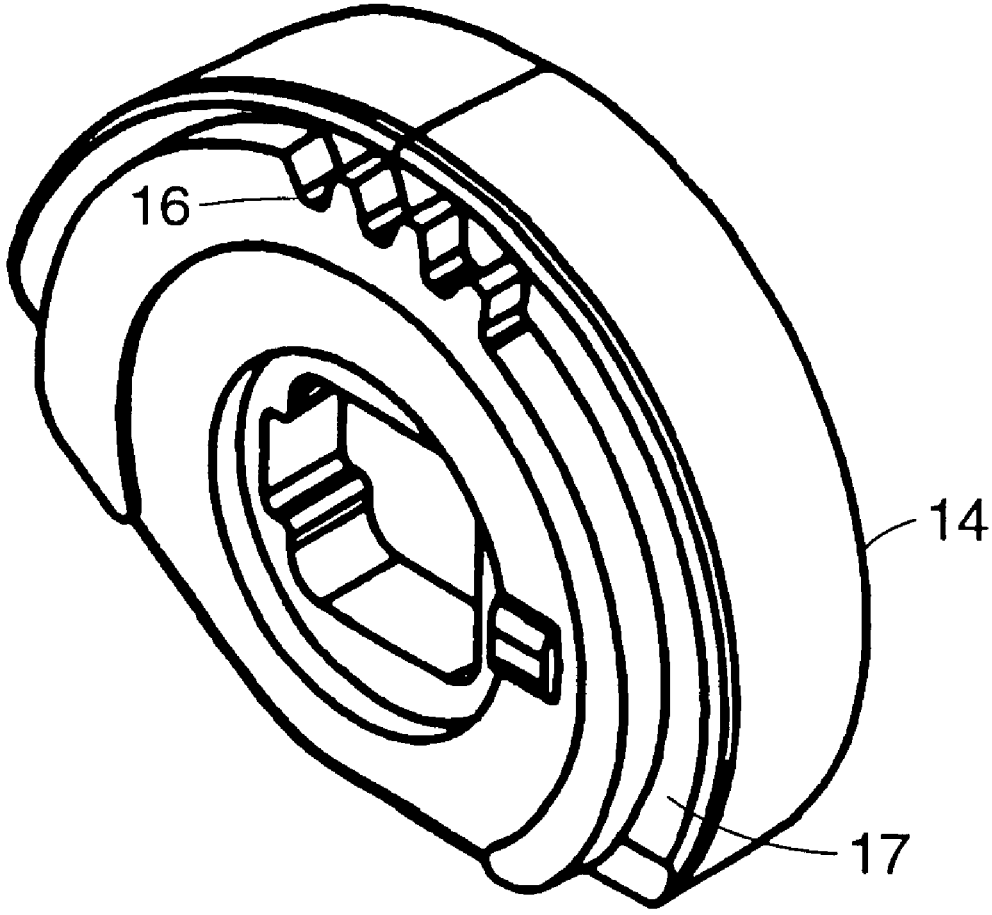
FIG. 11 is a perspective view of an embodiment of the current invention illustrating a keeper.
Figure 12:
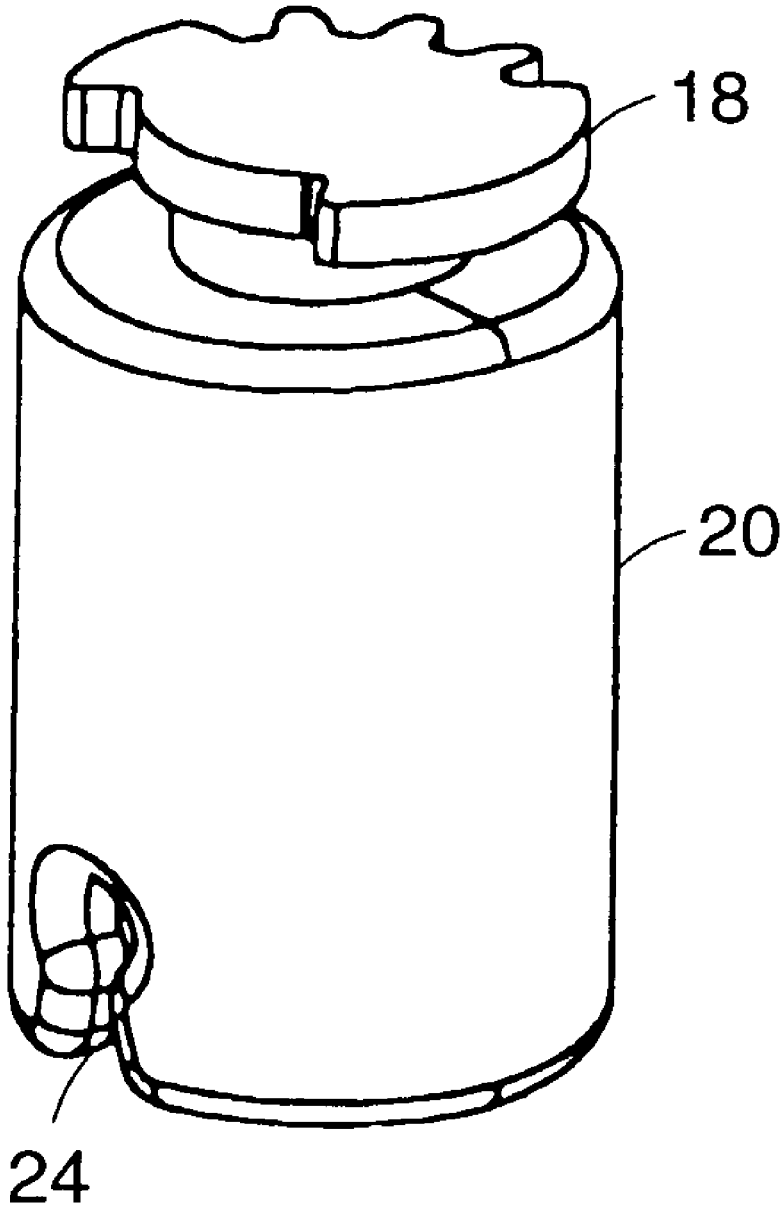
FIG. 12 is a perspective view of an embodiment of the current invention illustrating a gear and contoured outer surface.
Figure 13:
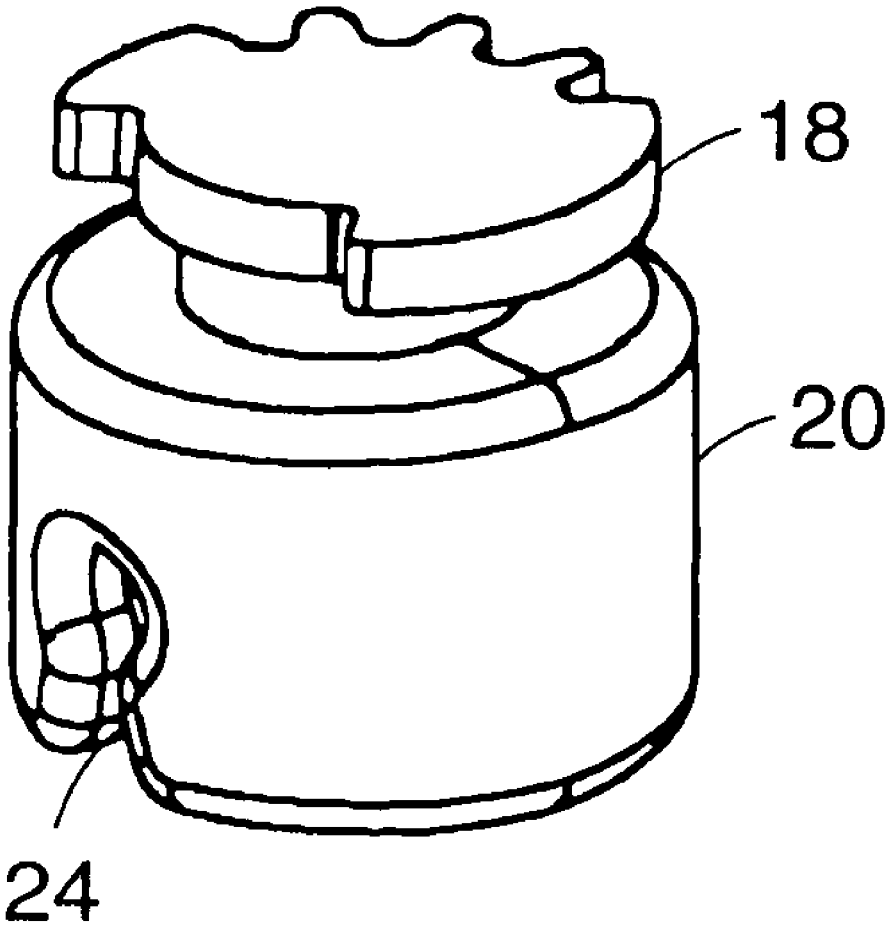
FIG. 13 is a perspective view of an embodiment of the current invention illustrating a gear and contoured outer surface.
Figure 14:
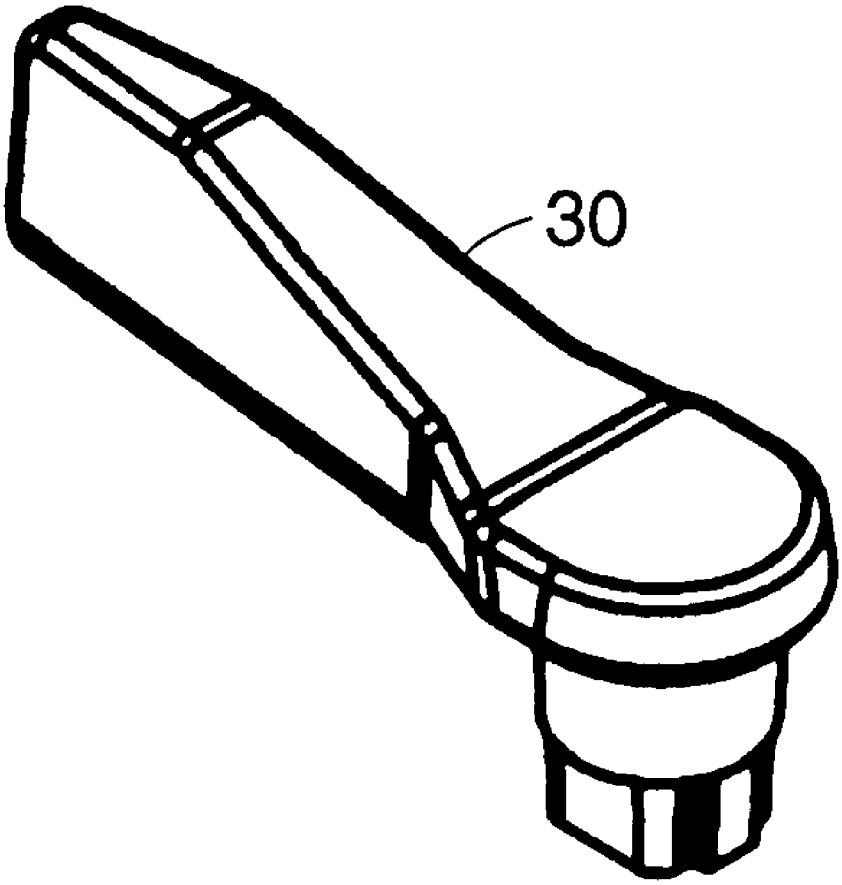
FIG. 14 is a perspective view of an embodiment of the current invention illustrating a lever.

FIG. 1B shows a schematic diagram of one embodiment of the present invention of a tilt lock latch mechanism 10 installed in the first window sash 2. The tilt lock latch mechanism 10 has a rotatable element 12 having a sash lock cam or keeper 14 with a toothed portion 16 (FIG. 2B). FIG. 10 shows a perspective bottom view of one embodiment of the keeper 14. FIG. 11 shows a perspective top view of the keeper 14. Toothed portion 16 of the rotatable element 12 meshes with a gear 18 (FIG. 3) to turn a contoured outer surface 20 attached thereto. FIG. 12 shows a perspective view of one embodiment of the gear 18 and contoured outer surface 20. FIG. 13 shows a perspective view of a low profile embodiment of the gear 18 and contoured outer surface 20 for use in the low profile flush mount embodiment depicted in FIG. 9. A ligament 22 is positioned in slots 24 formed in the contoured outer surface 20. The ligament 22 has two ends 26 and each end 26 is attached to a retractable element 28 mounted on opposite side edges of the sash 2. A lever 30 is attached to the keeper 14 for manual actuation. FIG. 14 shows a perspective view of one embodiment of the lever 30. As the lever 30 is rotated, the toothed portion 16 of the keeper 14 rotates the gear 18, which rotates the contoured outer surface 20. The ligament 22 wraps around the contoured outer surface 20 as the contoured surface 20 rotates, thereby pulling the retractable elements 28 into the window sash 2 allowing the window sash 2 to tilt.

Figure 1C:
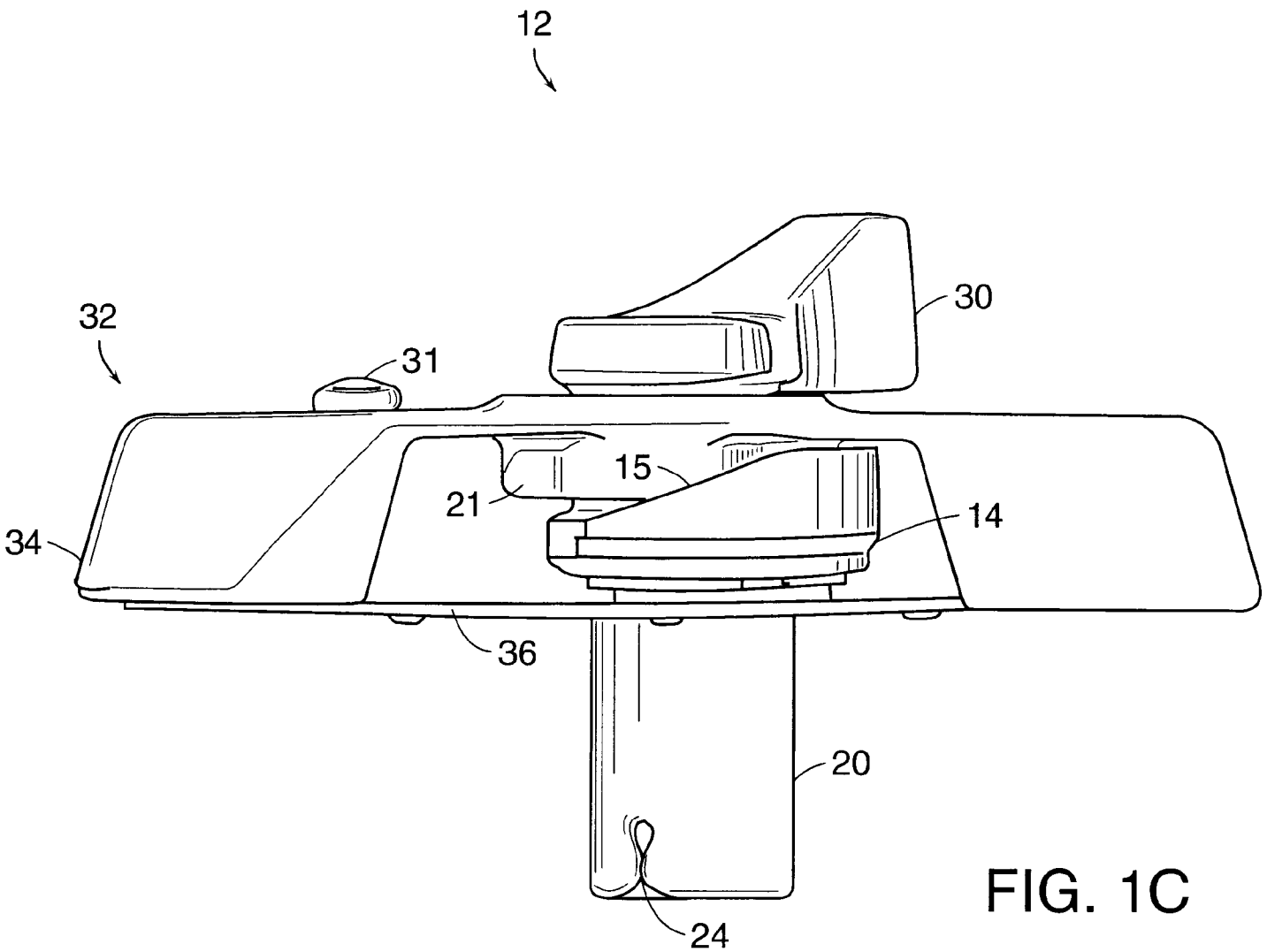
FIG. 1C is a front view of an embodiment of the current invention illustrating a housing, a keeper, a contoured outer surface, and a lever.
Figure 15:
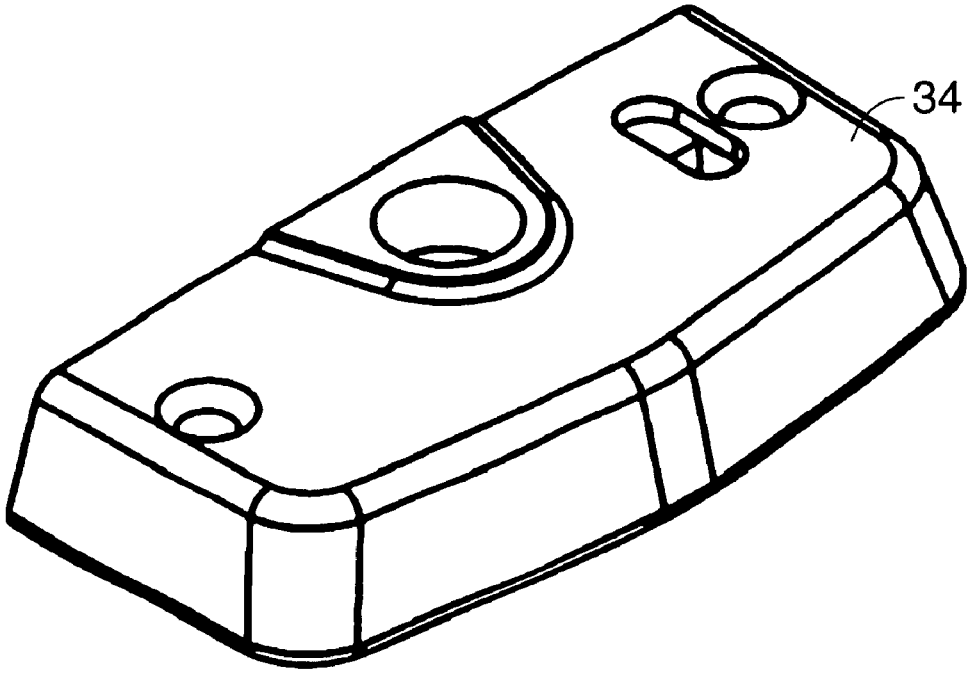
FIG. 15 is a perspective view of an embodiment of the current invention illustrating a cover plate.
Figure 16:
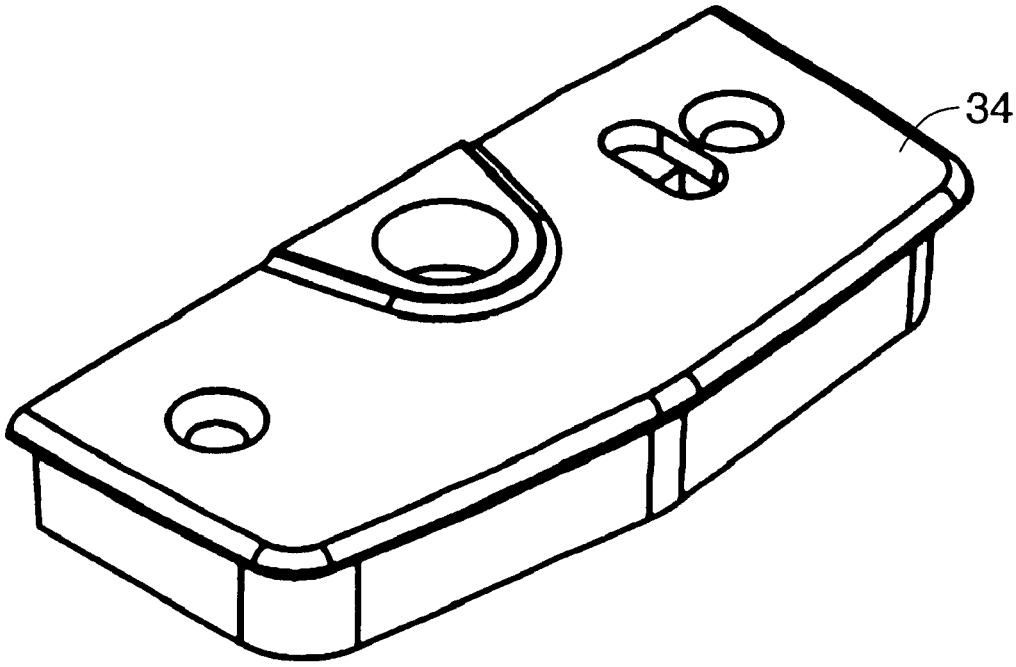
FIG. 16 is a perspective view of an embodiment of the current invention illustrating a cover plate.
Figure 17:
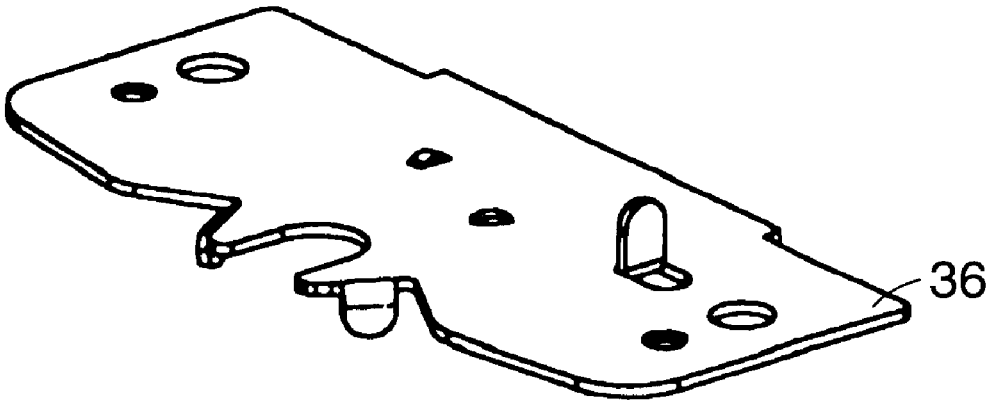
FIG. 17 is a perspective view of an embodiment of the current invention illustrating a bottom plate.

Referring to FIG. 1C, shown is a front view of one embodiment of a portion of the tilt latch lock mechanism 10 of the present invention including the rotatable element 12. As shown, a housing 32 includes a cover plate 34 and a bottom plate 36. FIG. 15 shows a perspective view of one embodiment of the cover plate 34 for mounting on an upper rail of the sash 2. FIG. 16 shows a perspective view of another embodiment of the cover plate 34 for mounting flush with an upper surface of the sash 2. FIG. 17 shows a perspective view of one embodiment of the bottom plate 36. Also shown in FIG. 1C is the keeper 14, having a sloped cylindrical surface 15 that is received by a receiver having a slot mounted to the second window sash 4 to prevent relative sliding movement of the first window sash 2 to the second window sash 4. The keeper 14 is manually actuated by the lever 30. Also shown is release button 31, which prevents movement of the lever 30 into an angular tilt position, which will be described in detail below. Finally, also shown is the contoured outer surface 20 and one of the slots 24 in the contoured surface.

Figure 3:
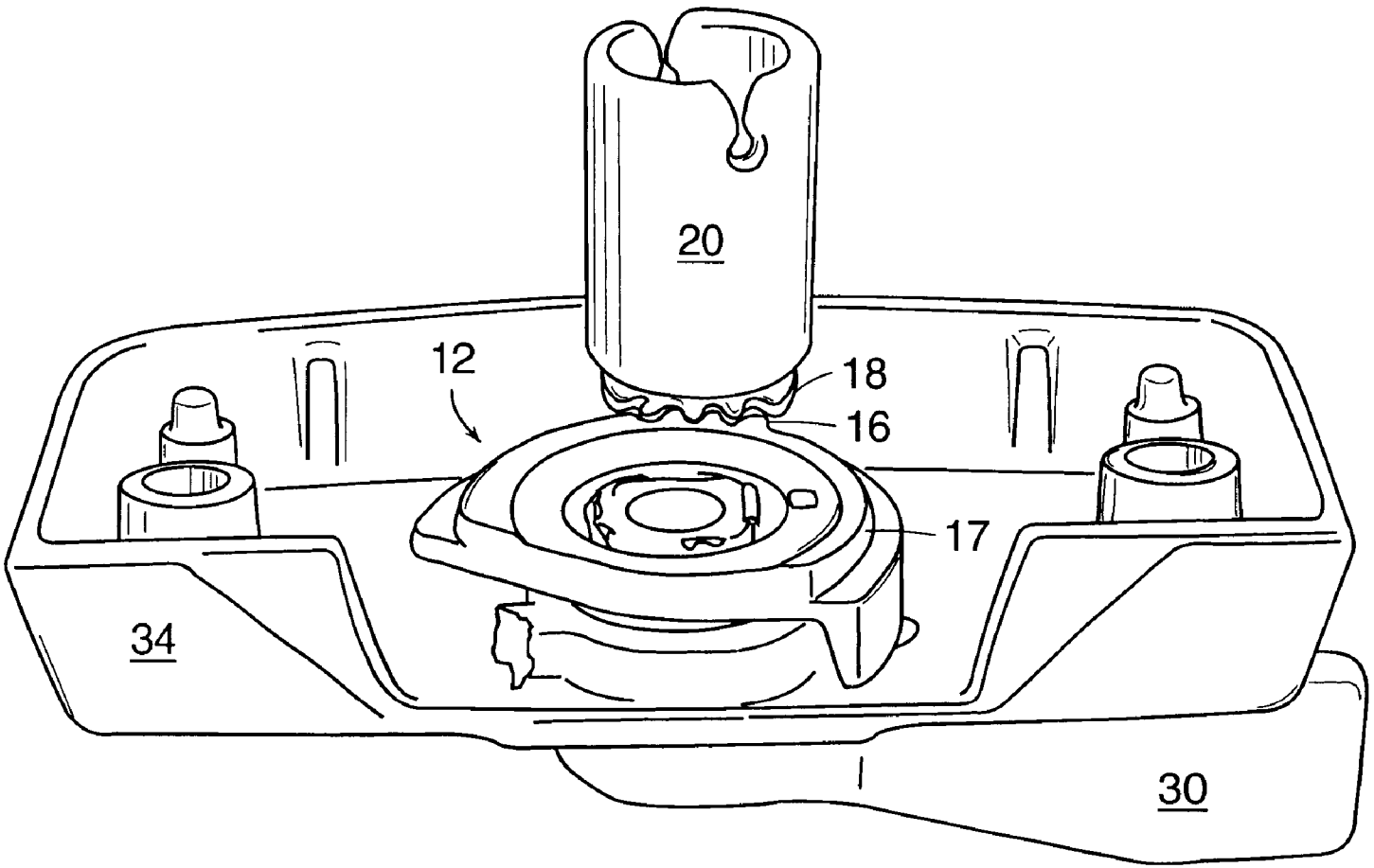
FIG. 3 is a bottom view of an embodiment of the current invention illustrating the alignment of the toothed portion of the keeper, and the gear.

Referring to FIG. 2B, shown is a bottom view of one embodiment of a portion of the tilt latch lock mechanism 10 of the present invention with the bottom plate 36 displaced. FIG. 2B shows the keeper 14 and the toothed portion 16 of the keeper 14 inside the cover plate 34. The keeper 14 is manually actuated by lever 30. FIG. 2B is a side view of the contoured outer surface 20 that is connected to the gear 18. When assembled, the gear 18 meshes with toothed portion 16, as best seen in FIG. 3. Also shown in FIG. 2B is a release button slot 37 to allow the release button 31 to protrude through the cover plate 34. Finally, the bottom plate 36 forms a bottom plate slot 35, to allowed the contoured outer surface 20 to be outside of the bottom plate 36 while maintaining the gear 18 inside the cover plate 34 in engagement with the toothed portion 16.

Referring again to FIG. 3, shown is a bottom perspective view of the cover plate 34 with the bottom plate 36 removed. FIG. 3 shows gear 18 in an assembled position to illustrate the meshing of gear 18 with toothed portion 16.

Figure 4:
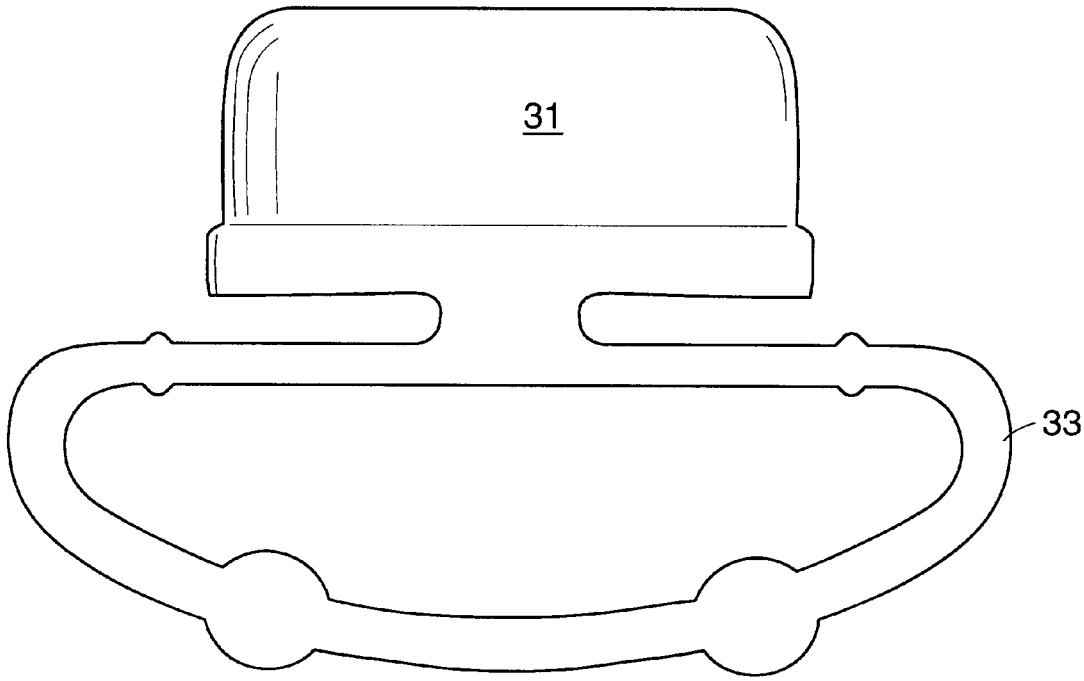
FIG. 4 is a side view of a release button and a release button spring.
Figure 18:
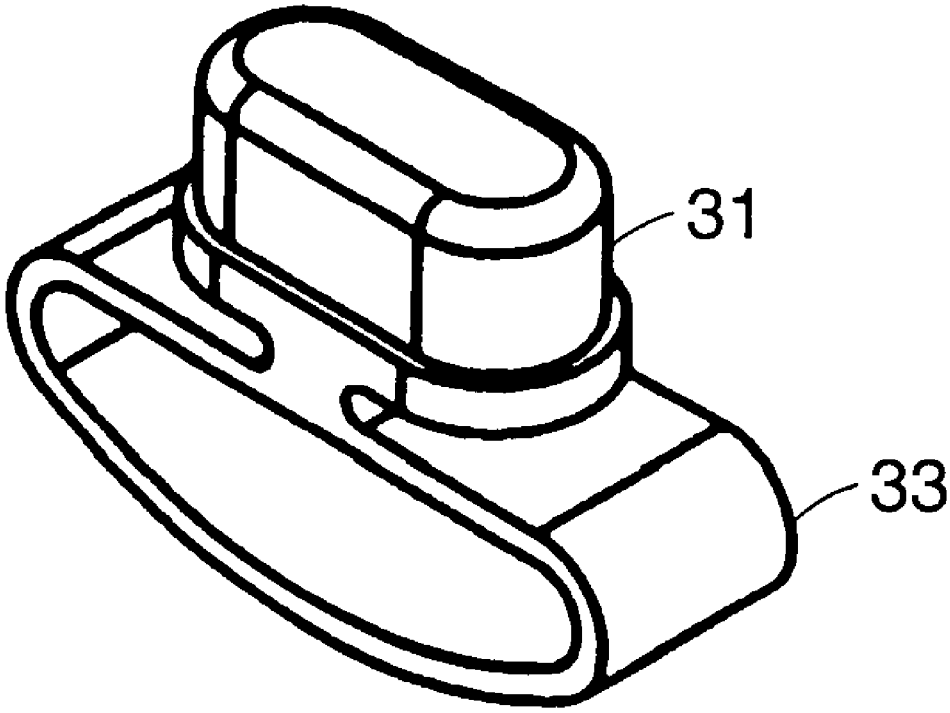
FIG. 18 is a perspective view of an embodiment of the current invention illustrating a release button and release button spring.

Referring to FIG. 4, shown is a side view of the release button 31 and release button spring 33, which may be formed integrally therewith of a compliant, resilient polymer or other suitable material. FIG. 18 shows a perspective view of the release button 31 and release button spring 33. In another embodiment, the release button spring 33 and release button 31 can be two separate components.

Figure 5:
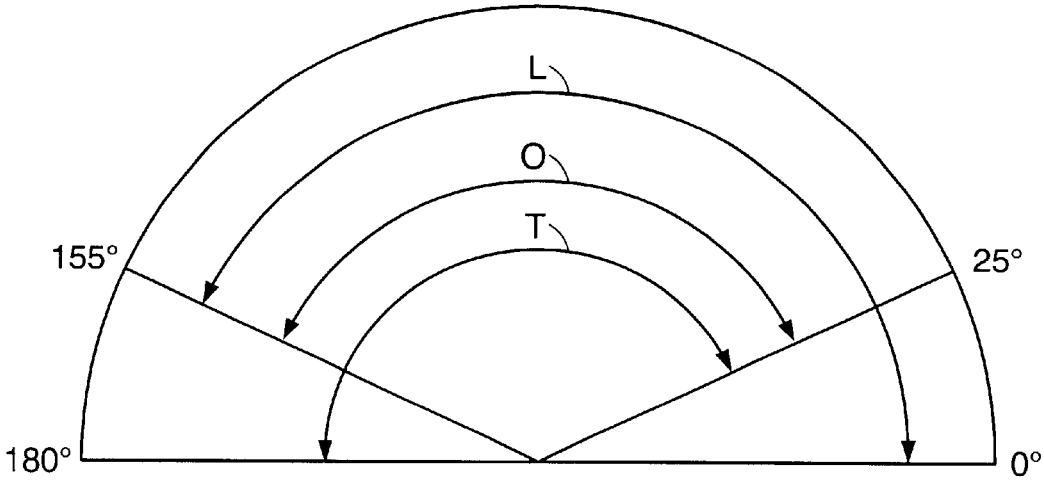
FIG. 5 is a schematic diagram of an embodiment of the present invention illustrating locked, open, and tilt angular position ranges of the rotatable element.

The rotatable element 12 of the tilt lock latch mechanism 10 has an angular range of operation of about 180 degrees and three angular ranges for its operating positions. In a first angular position, or locked position, the keeper 14 is received in a receiver in the second window sash 4 to prevent relative sliding motion of the first window sash 2 to the second window sash 4, i.e., the window is locked. The locked position can be defined as an angular position range of the lever 30 from about 0 degrees (e.g., when the lever 30 is aligned with the upper rail of the sash 2) to about 155 degrees, or preferably from an angular position range from about 0 degrees to about 135 degrees. FIG. 5 shows the range of the locked position of the lever 30 indicated by the arc labeled with a "L."

In a second angular position, or open position, the keeper 14 is withdrawn from the receiver in the second window sash 4 allowing relative sliding motion of the first window sash 2 and the second window sash 4. The open position can be defined as an angular position range of the lever 30 from about 25 degrees to about 155 degrees, or preferably from an angular position range from about 90 degrees to about 155 degrees, or more preferably at an angular position of about 135 degrees. FIG. 5 shows the range of the lever 30 in open position indicated by the arc labeled with a "O." Note that the release button 31 can be positioned so that the lever 30 contacts the release button 31 when the lever 30 is at the desired open angular position, such as 135 degrees.

In a third angular position, or tilt position, the gear 18 is engaged and driven by the toothed portion 16 of the rotatable element 12 to rotate contoured outer surface 20, wrap the ligament 22 thereabout, and withdraw the retractable elements 28 to allow the first window sash 2 to tilt. Note that in this embodiment, the toothed portion 16 of the rotatable element 12 does not engage the gear 18 until the third angular position is reached, because the rotatable element 12 includes a sector 17 having a radial relief. Tilt position can be defined as an angular position range of the lever 30 from about 25 degrees to about 180 degrees, or preferably from an angular position range from about 90 degrees to about 180 degrees, or more preferably from an angular position range from about 135 degrees to about 180 degrees. FIG. 5 shows the range of the tilt position of the lever 30 indicated by the arc labeled with a "T."

Figure 6:
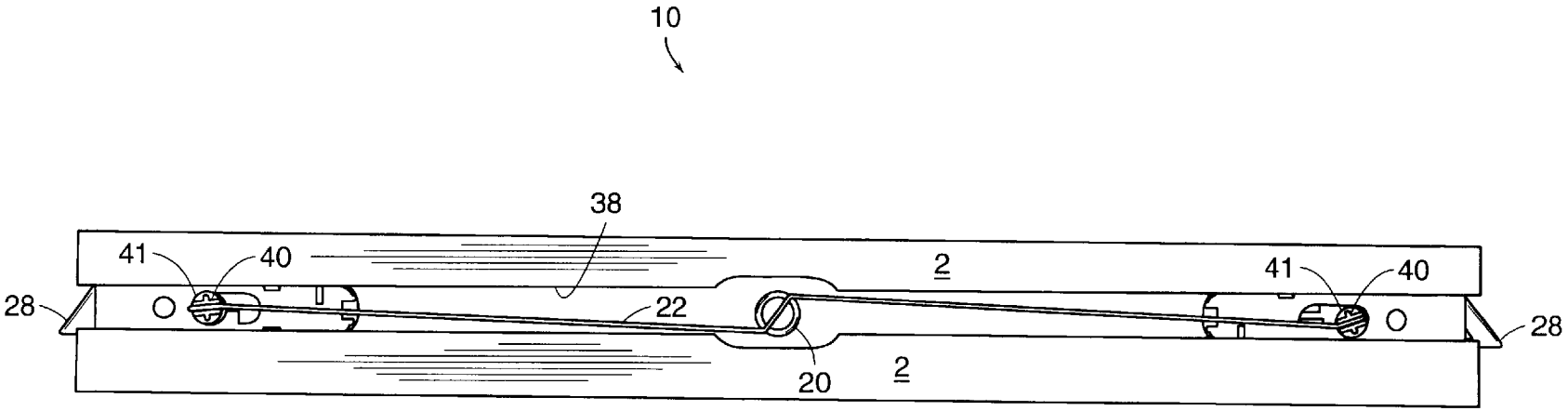
FIG. 6 is a bottom view of an embodiment of the current invention illustrating a contoured surface, ligament, adjustment mechanisms, and retractable elements.
Figure 19:
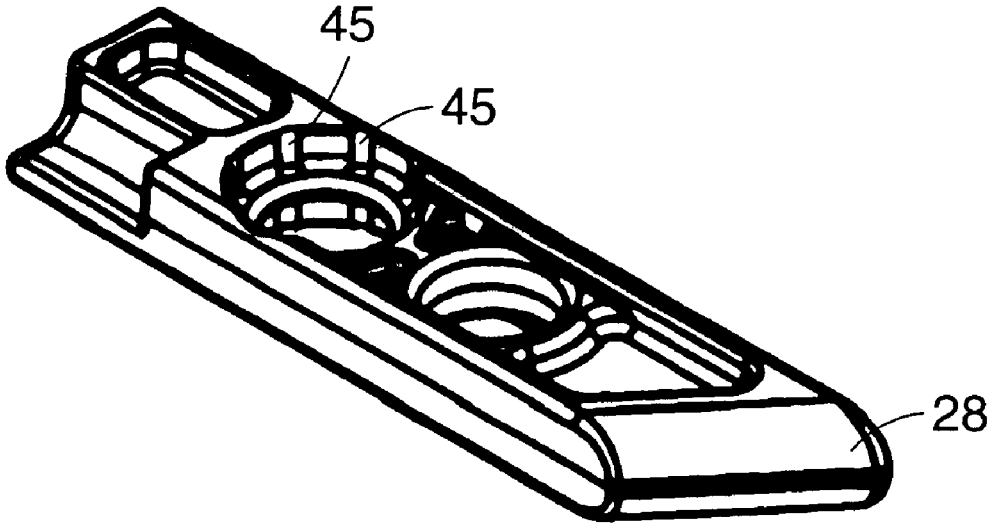
FIG. 19 is a perspective view of an embodiment of the current invention illustrating a retractable element.

Referring to FIG. 6, shown is a bottom view of the tilt lock latch mechanism 10, which highlights the retractable elements 28, shown partially retracted. FIG. 19 shows a perspective view of one embodiment of the retractable element 28. The retractable element 28 can also be called a retractable tilt latch, or an adjustable tilt latch. The ligament 22 can be a rope, cable, wire, string, thread, rod, band, chain, cord, or any other structure known to those skilled in the art suitable for transmitting a retraction force between the contoured outer surface 20 and each retractable element 28. The ligament 22 can be made of any suitable material including polymer, metal, natural or synthetic fibers, and combinations thereof. The ligament 22 can be positioned in a channel 38 formed in the upper rail of first window sash 2. The retractable elements 28 are also contained within the window sash 2. The retractable elements 28 are installed in recesses in the sides of the window sash 2. An adjustment mechanism 40, which in one embodiment can be a screw, is received in the retractable element 28 to anchor the ligament 22. The mechanism 40 can be used to wrap the ligament 22 around an outside surface 41 of the adjustment mechanism to adjust the length of the ligament 22.

Figure 7:
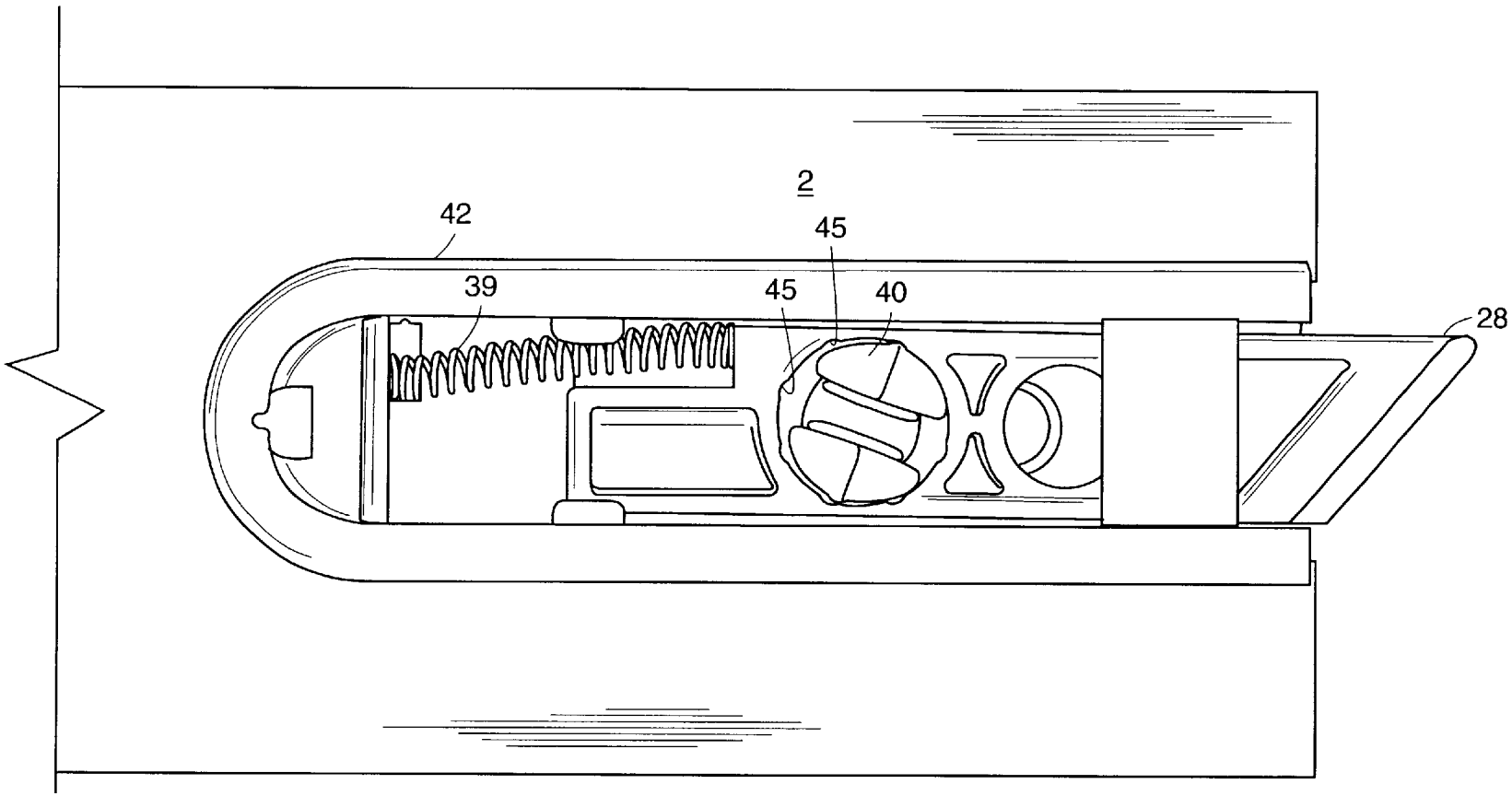
FIG. 7 is a top view of an embodiment of the current invention illustrating a spring, the adjustment mechanism, a retractable element housing, and retractable element.
Figure 20:
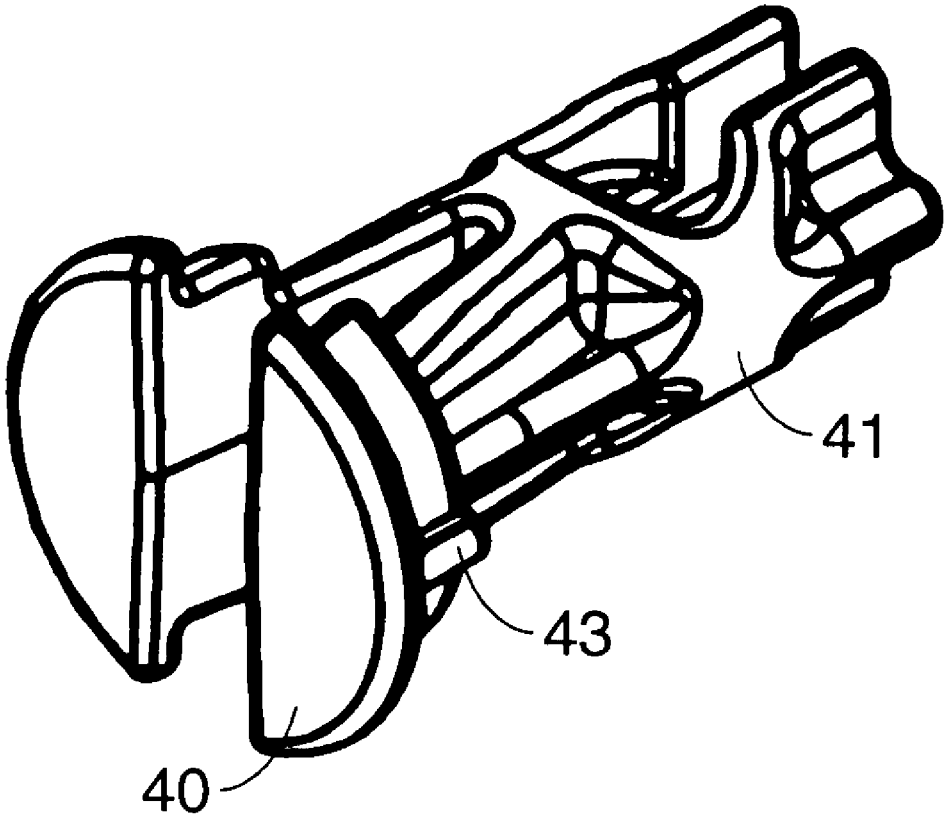
FIG. 20 is a perspective view of an embodiment of the current invention illustrating an adjustment mechanism.
Figure 21:
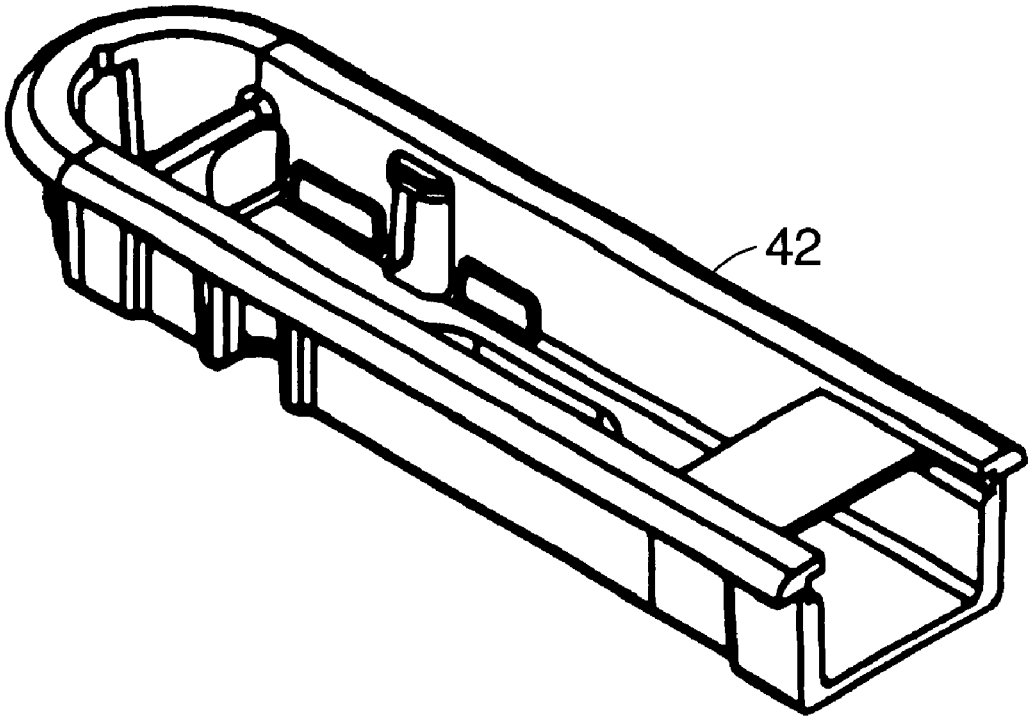
FIG. 21 is a perspective view of an embodiment of the current invention illustrating a retractable element housing.
Figure 22:
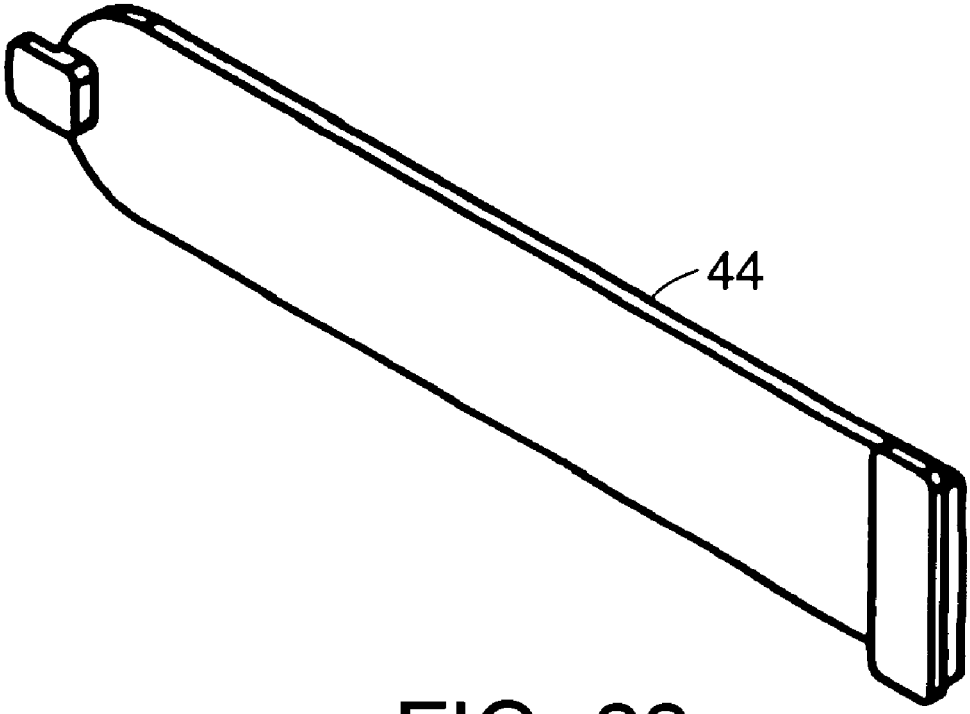
FIG. 22 is a perspective view of an embodiment of the current invention illustrating a retractable element housing cover plate.

FIG. 7 shows an enlarged top view of one of the retractable elements 28. A compressed spring 39 is disposed in the retractable element housing 42 to bias the retractable element 28 outwardly into its window slot 8. In addition, FIG. 7 also shows a top view of the adjustment mechanism 40, which can be adjusted by a screwdriver disposable in a slot formed in the upper surface thereof. FIG. 20 shows an enlarged perspective view of one embodiment of the adjustment mechanism 40. FIG. 21 shows a perspective view of one embodiment of the retractable element housing 42. The adjustment mechanism includes one or more radially extending ribs 43 which mate with depressions 45 circumferentially spaced about a perimeter of a bore in which the adjustment mechanism 40 is received in the retractable element 28. Accordingly, the mechanism 40 can be turned with a screwdriver to eliminate any slack in and preliminarily tension the ligament 22.

In the embodiment depicted in FIGS. 1–7, the lever 30 and rotatable element 12 "free wheel" between the locked and open position, rotating solely the keeper 14. Only when the lever 30 is rotated past the open position into the tilt position, does the toothed portion 16 engage and rotate the gear 18 to tension further the ligament 22 and retract the retractable elements 28.

In the embodiment depicted in FIGS. 1–7, in order to rotate the lever 30 past the open position into the tilt position, the user depresses the lever release button 31 or, alternatively forces the lever 30 past the button 31, which acts as a detent. By depressing the lever release button 31, the lever 30 is now free to be rotated to the beginning range of the tilt position, which can be 135 degrees. The release button spring 33 is disposed under the release button 31. The release button spring 33 provides a resilient force to bias the release button 31 into the raised position. At the start of the tilt position range, the toothed portion 16 engages the gear 18. As the lever 30 is moved from the start of the tilt position, for example 135 degrees, to the end of the tilt position, for example 180 degrees, the lever 30 rotates the toothed portion 16, the gear 18, and the contoured outer surface 20. The ligament 22 passes through the slots 24 in the contoured outer surface 20. Upon rotation of the contoured outer surface 20, the ligament 22 wraps around the contoured outer surface 20, which pulls retractable elements 28 into the window sash 2 and out of the window slots 8, allowing the window sash 2 to tilt. As best seen in FIG. 10, a stop 19 is provided on the keeper 14, which cooperates with abutting structure 21 on the housing 32, to prevent over travel of the rotatable element 12 past the angular limits of the locked and tilt positions.

Figure 8:
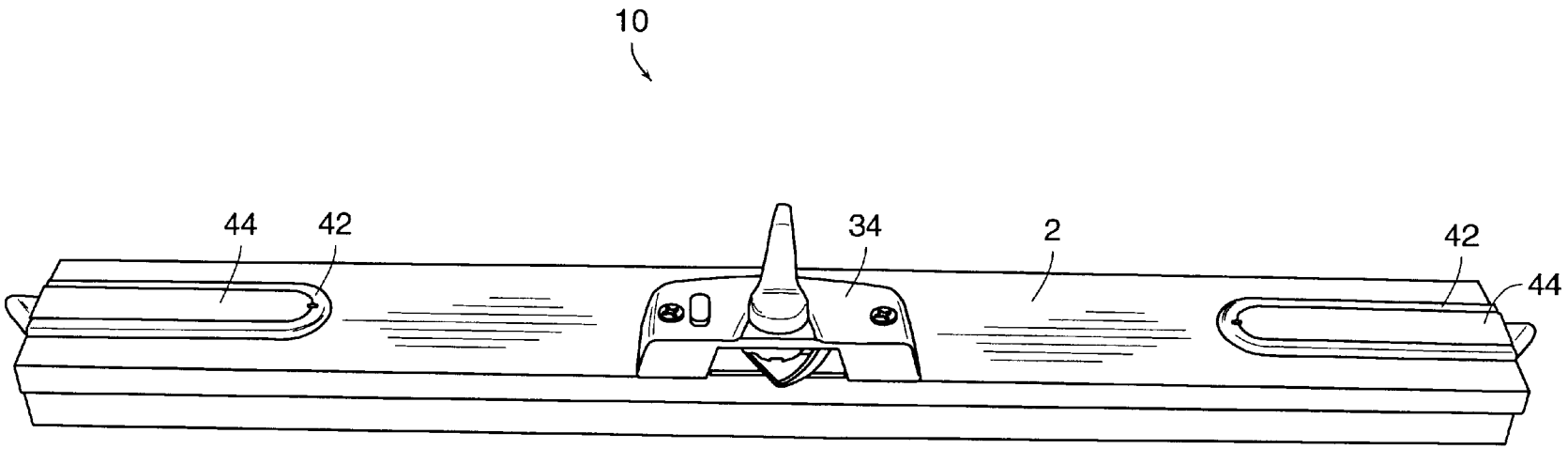
FIG. 8 is a perspective view of an embodiment of the current invention illustrating the cover plate mounted on the window sash.

FIG. 8 is a perspective view of an embodiment of the current invention illustrating the cover plate 34 mounted on the window sash 2. FIG. 8 also shows retractable element housing cover plates 44 used to enclose the retractable element housings 42 and provide a finished appearance.

Figure 9:
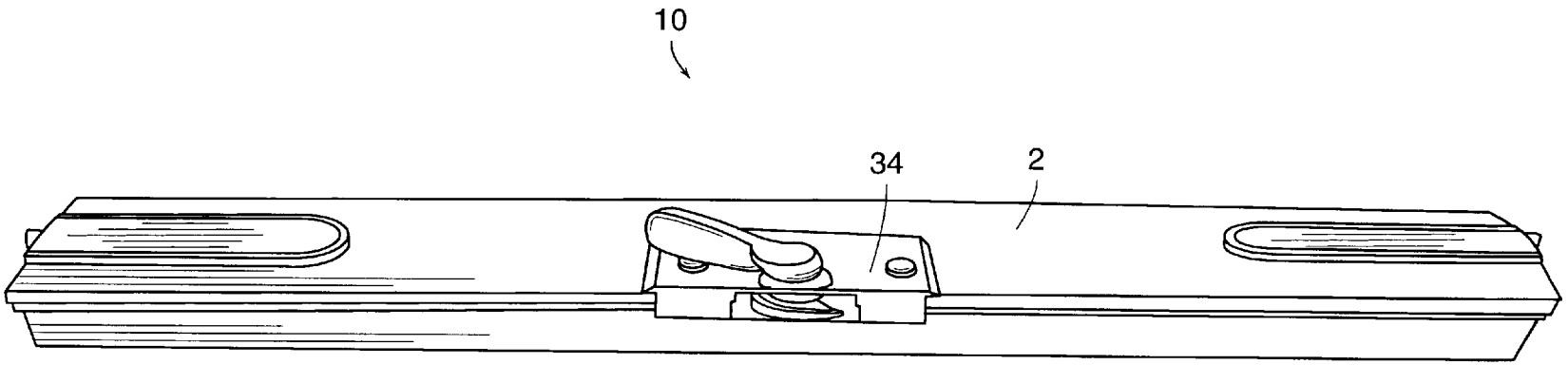
FIG. 9 is a perspective view of an embodiment of the current invention illustrating the cover plate mounted flush to the window sash.

FIG. 9 is a perspective view of an embodiment of the current invention illustrating the cover plate 34 mounted flush to the window sash 2, to provide a low profile appearance.

Alternative transmissions can be provided to connect rotational movement of the lever to ligament tension.

In a second embodiment, the tilt lock latch mechanism has a rotatable element having a sash lock cam or keeper and a toothed portion. The toothed portion of the rotatable element meshes with a gear to turn a contoured outer surface attached thereto. A ligament is positioned in slots of the contoured outer surface. The ligament has two ends and each end is attached to a retractable element mounted on an edge of the sash. A lever is attached to the rotatable element for manual actuation. As the lever is actuated, the toothed portion of the rotatable element rotates the gear which in turn rotates the contoured outer surface. The ligament wraps around the contoured outer surface as the contoured surface rotates, which pulls the retractable elements into the window sash allowing the window sash to tilt.

A housing includes a cover plate and a gearbox. The keeper is received by a receiver having a slot in the second window sash to prevent relative sliding movement of the first window sash to the second window sash. The keeper is manually actuated by the lever. The contoured outer surface is connected to the gear, and the gear is located inside the gearbox.

An adapter or connector is used to connect the keeper and the top of the toothed portion. The connector, keeper, and toothed portion are part of the rotatable element. The rotatable element rotates when the lever is actuated by a user.

There is an internal tab in a bore of the toothed portion. When the lever is rotated to a tilt position, as defined further hereinbelow, the tab is engaged by the adapter or connector between the keeper and the toothed portion, rotating the toothed portion.

The toothed portion forms a bore. The internal tab is located on the top surface of the toothed portion next to the bore. A connector has a first end and a second end. In the present embodiment, the first end of the connector is inserted into or may be integral with the keeper. The second end of the connector is inserted into the bore of the toothed element. The second end of the connector has a slot (e.g., 135 degrees) to enable the connector to "free wheel" until the internal tab at the top of the toothed portion is engaged by the connector. When the internal tab is engaged by the connector, the gear is then rotated by the toothed portion.

The connector has a slot of about 135 degrees, although the angular extent can vary, depending on the actuation ranges discussed in more detail below.

The toothed portion of the rotatable element meshes with the gear. The gear further includes the contoured outer surface having slots to accept the ligament. In one configuration, the gear and tooth portion can be before the tab in the top surface of the tooth portion to engage the adapter or connector to rotate the gear.

As the top surface of the tooth portion is engaged by the adapter or connector and is rotated to a retract position, there is a change in the toothed portion and the gear as compared to the end of the open position. There is also a corresponding change in position of the contoured outer surface.

In this embodiment, the rotatable element of the tilt lock latch mechanism has an angular range of operation of about 180 degrees and three angular ranges for its operating positions. In a first angular position, or locked position, the keeper is received in a receiver in the second window sash to prevent relative sliding motion of the first window sash to the second window sash, i.e., the window is locked. The locked position can be defined as an angular position range of the lever 30 from about 0 degrees to about 155 degrees, or preferably from an angular position range from about 0 degrees to about 135 degrees.

In a second angular position, or open position, the keeper is withdrawn from the receiver in the second window sash allowing relative sliding motion of the first window sash and the second window sash. The open position can be defined as an angular position range of the lever 30 from about 25 degrees to about 155 degrees, or preferably from an angular position range from about 90 degrees to about 155 degrees, or more preferably at an angular position of about 135 degrees. Note that a detent can be added to the cover plate or gearbox of the housing to indicate the lever is in a desired open angular position, such as 135 degrees.

In a third angular position, or tilt position, the gear is driven by the toothed portion of the rotatable element to rotate contoured outer surface and withdraw the retractable elements to allow the first window sash to tilt. Tilt position can be defined as an angular position range of the lever from about 25 degrees to about 180 degrees, or preferably from an angular position range from about 90 degrees to about 180 degrees, or more preferably from an angular position range from about 135 degrees to about 180 degrees.

The retractable element can also be called a retractable tilt latch, or an adjustable tilt latch. The ligament can be a rope, cable, wire, string, thread, rod, band, chain, cord, or any other structure known to those skilled in the art suitable for transmitting retraction force between the gearbox and the retractable element. The ligament can be made of any suitable material including polymer, metal, natural or synthetic fibers, and combinations thereof. The retractable element is contained within the window sash. The retractable element is installed in a recess in the side of the sash. An adjustment mechanism, which in one embodiment can be a screw, can be used to modify the relative position of the ligament to at least one of the retractable elements. A compressed spring can be used to bias the retractable element into its window slot.

A flange can be used for supporting the retractable element. The flange also has a flange hole to allow access to the adjustment mechanism. The adjustment mechanism extends through the flange. In use, the adjustment mechanism is within the sash. The adjustment mechanism can be adjusted with a screwdriver to adjust the extension of the retractable element. Rotation in one direction extends the retractable element out of the sash and rotation in the other direction withdraws the retractable element into the sash.

The adapter or connector that connects the keeper and the toothed portion is connected to the keeper. The other end of the connector or adapter mates with the bore of the toothed portion and contacts the tab when rotated between the open and tilt positions.

A gearbox maintains the mesh between toothed portion and gear throughout the angular range of travel of the lever. The lever "free wheels" between the locked and open position, rotating solely the keeper. Only when the lever is rotated past the open position into the tilt position, does the connector or adapter engage the tab and rotate the toothed portion and gear to tension the ligament and retract the retractable elements.

In a third embodiment, the gears are meshed and engaged when moving the lever from the open to tilt positions and are disengaged when moving the lever to the locked positions. In this embodiment of the present invention, the housing forms a cover plate for supporting the rotatable element, which includes a toothed portion for meshing with gear at certain angular positions.

In one embodiment, the ligament is a cord with a crimped ferrule at an end thereof. In addition, the contoured outer surface mounts on the axial tab of gear.

In a fourth embodiment of the present invention, a different transmission is used which obviates the need for the toothed portion and the gear, using a radial arm on a spindle.

A housing includes a cover plate and a transmission box. A keeper is received by a receiver having a slot, and the receiver mounted on the second window sash to prevent relative sliding motion of the first window sash to the second window sash. The keeper is manually actuated by a lever. This embodiment of the invention, like the other embodiments of the invention, includes a rotatable element which also rotates serially from a first angular locked position, to a second angular open position, to a third angular tilt position. This embodiment of the current invention includes a release button. The release button prevents the lever from being moved from the open position to the tilt position until the release button is depressed. The release button prevents a user from unintentionally actuating the lever to the tilt position.

In this embodiment, the spindle extending from the transmission box. A contoured outer surface is attached to the spindle. The housing includes the cover plate and the transmission box release button spring is disposed in a bore in the bottom of the release button. The release button spring provides a resilient force to bias the release button into the raised position whenever the lever is not in the tilt position.

The radial arm is attached to the spindle, which passes through the bottom of the transmission box. In this embodiment, the rotatable element includes the keeper with a keeper lip. The keeper "free wheels" through the locked and open positions. The angular range of the locked, open, and tilt positions of this embodiment are similar to the locked, opened, and tilt positions of the other embodiments previously disclosed in this specification, any and all of which can be varied, as desired.

To tilt the first sash of this embodiment of the invention, the user depresses the release button. By depressing the release button, this allows the lever to be rotated to the beginning range of the tilt position, which can be 135 degrees. At the start of the tilt position range, the keeper lip engages the radial arm. As the lever is moved from the start of the tilt position, for example 135 degrees, to the end of the tilt position, for example 180 degrees, the keeper lip rotates the radial arm, which rotates both the spindle and the contoured outer surface. As in the other disclosed embodiments, a ligament is inserted into slots in the contoured outer surface. Upon rotation of the contoured outer surface, the ligament wraps around the contoured outer surface which pulls retractable elements into the window sash allowing the window sash to tilt. The transmission box including the radial arm and a stop. The stop prevents the radial arm from traveling past the end of the tilt angular range.

While there have been described several embodiments of the invention, other variants and alternatives will be obvious to those skilled in the art. Accordingly, the scope of the invention is not limited to the specific embodiments shown, but rather should be construed from the claims, including all equivalents.

What is claimed is:

1. A window tilt lock latch mechanism comprising:

(a) a housing;

(b) a rotatable element including a keeper coupled to the rotatable element, such that rotation of the rotatable element rotates the keeper, the rotatable element mounted to the housing;

(c) at least one retractable element disposable remote from the housing; and (d) a transmission connecting the rotatable element with the retractable element, wherein:

when the window tilt lock latch is mounted in a first window sash and the rotatable element is at a first angular position, the rotatable element keeper is received in a receiver in a second window sash to prevent relative movement of the first window sash and the second window sash;

when the rotatable element is at a second angular position, the rotatable element keeper is removed from the receiver in the second window sash; and when the rotatable element is at a third angular position, the rotatable element retracts the retractable element to permit the first window sash to be tilted away from the second window sash, wherein, the rotatable element rotates serially from the first angular position to the second angular position to the third angular position.

2. The tilt lock latch mechanism of claims 1 wherein the first angular position of the rotatable element relative to the housing comprises an angular range of up to about 155 degrees.

3. The tilt lock latch mechanism of claim 1 wherein the second angular position of the rotatable element relative to the housing comprises an angular range of up to about 130 degrees.

4. The tilt lock latch mechanism of claim 1 wherein the third angular position of the rotatable element relative to the housing comprises an angular range of up to about 155 degrees.

5. The tilt lock latch mechanism of claim 1 wherein the transmission comprises a ligament.

6. The tilt lock latch mechanism of claim 1, wherein the retractable element is biased in an extended position.

7. The tilt lock latch mechanism of claims 1, wherein the rotatable element further comprises a lever for manual actuation.

8. A tilt lock latch mechanism for use in a window assembly, the window assembly including a window frame having a pair of window frame slots, a first window sash, and a second window sash, the tilt lock latch mechanism comprising:

a housing adapted to be mounted on the first window sash;

a rotatable element including a keeper mounted on the housing, the keeper coupled to the rotatable element, such that a rotation of the rotatable element rotates the keeper;

a receiver adapted to be mounted on the second window sash to accept the rotatable element keeper to prevent relative movement between the first window sash and the second window sash when the rotatable element is moved to a locked position, and to permit relative sliding movement between the first window sash and the second window sash when the rotatable element is moved to an open position;

a pair of retractable tilt latches adapted to be disposed on opposite ends of the first window sash in communication with respective window frame slots for supporting the first window sash in sliding relation; and a transmission interdisposed between the rotatable element and the pair of retractable tilt latches, wherein the pair of retractable tilt latches are retracted from the window frame slots into the first window sash when the rotatable element is moved beyond the open position to a tilt position permitting the first window sash to be tilted relative to the window frame, wherein the rotatable element rotates serially from the lock position to the open position to the tilt position.

9. The tilt lock latch mechanism according to claim 8 wherein the transmission comprises:

a gear meshing with a toothed portion of the rotatable element; and a ligament interdisposed between the gear and the retractable tilt latches, wherein when the rotatable element is turned from the open position to the tilt position, the gear is turned and tension is applied to the ligament to actuate the retractable tilt latches.

10. The tilt lock latch mechanism according to claim 9 wherein the gear further comprises a contoured surface upon which the ligament wraps when the gear is turned.

11. The tilt lock latch mechanism according to claim 8 wherein a single lever is attached to the rotatable element to enable locking and tilting of the first window sash.

12. The tilt lock latch mechanism according to claim 8, wherein the locked position corresponds to an angular position of the rotatable element relative to the housing in an angular range of up to about 155 degrees.

13. The tilt lock latch mechanism according to claim 8, wherein the open position corresponds to an angular position of the rotatable element relative to the housing in an angular range of up to about 130 degrees.

14. The tilt lock latch mechanism according to claim 8, wherein the tilt position corresponds to an angular position of the rotatable element relative to the housing in an angular range of up to about 155 degrees.

15. The tilt lock latch mechanism according to claim 8 wherein the pair of retractable tilt latches are biased toward the window frame slots when in use in the window assembly.

16. The tilt lock latch mechanism of claim 8 further comprising a detent between the open position and the tilt position.

17. The tilt lock latch mechanism of claim 8 wherein at least one of the pair of retractable tilt latches further comprises an adjustment mechanism for modifying relative position of the ligament to at least one of the retractable tilt latches.

18. The tilt lock latch mechanism according to claim 8 further comprising a release button to permit rotation of the rotatable element past the open position to the tilt position.

19. The tilt lock latch mechanism according to claim 8 further comprising a stop at end of rotation of the rotatable element at the tilt position.

20. A method of operating a tilt in window having a first sash and a second sash slidably engaged with at least one window frame slot, and a tilt lock latch mechanism having a lever for manual actuation, the tilt lock latch mechanism being attached to the first sash and including a retractable element coupled to the lever, the retractable element engaging the window frame slot, the tilt lock latch mechanism being attached to the first sash, the method comprising the steps of:

moving the lever to a first angular position to lock the first sash relative to the second sash and prevent relative sliding movement therebetween;

moving the lever to a second angular position to permit relative sliding movement of the first window sash and the second window sash; and moving the lever to a third angular position to retract the retractable element from the window frame slot to permit tilting of the first window sash relative to the second window sash.

* * * * *

UNITED STATES PATENT AND TRADEMARK OFFICE

CERTIFICATE OF CORRECTION

PATENT NO. : 6,817,142 B2
DATED : November 16, 2004
INVENTOR(S) : Marshik

It is certified that error appears in the above-identified patent and that said Letters Patent is hereby corrected as shown below:

Column 10,
Lines 23 and 39, the word "claims" should be deleted and replaced with the word -- claim --.

Signed and Sealed this

Twenty-second Day of March, 2005

JON W. DUDAS
*Director of the United States Patent and Trademark Office*